US012569074B2

(12) United States Patent
Crimmins et al.

(10) Patent No.: US 12,569,074 B2
(45) Date of Patent: Mar. 10, 2026

(54) INFANT SLEEP DEVICE

(71) Applicant: Halo Innovations, Inc., New York, NY (US)

(72) Inventors: Thomas Crimmins, New York, NY (US); Bryce Gibson, Dedham, MA (US)

(73) Assignee: Halo Dream, Inc., New York, NY (US)

( * ) Notice: Subject to any disclaimer, the term of this patent is extended or adjusted under 35 U.S.C. 154(b) by 250 days.

(21) Appl. No.: 18/192,407

(22) Filed: Mar. 29, 2023

(65) Prior Publication Data

US 2023/0309713 A1 Oct. 5, 2023

Related U.S. Application Data

(60) Provisional application No. 63/327,188, filed on Apr. 4, 2022.

(51) Int. Cl.
*A47D 9/00* (2006.01)

(52) U.S. Cl.
CPC ..... *A47D 9/012* (2022.08); *A47D 9/008* (2022.08)

(58) Field of Classification Search
CPC ..... A47D 9/00; A47D 9/005; A47D 9/008; A47D 9/012; A47D 9/016; A47D 9/02; A47D 9/04; A47D 9/053; A47D 9/057; A47D 11/00; A47D 11/005; A47D 11/007
See application file for complete search history.

(56) References Cited

U.S. PATENT DOCUMENTS

| | | | | | |
|---|---|---|---|---|---|
| 5,172,435 | A * | 12/1992 | Griffin | A47D 9/005 | 5/98.1 |
| 5,819,341 | A * | 10/1998 | Simantob | A47D 15/008 | 5/98.1 |
| 6,588,033 | B1 * | 7/2003 | Welsh, Jr. | A47D 7/002 | 5/98.1 |
| 8,429,771 | B2 * | 4/2013 | Long | A47D 9/012 | 5/100 |
| 9,962,012 | B1 * | 5/2018 | Schmid | A47D 9/012 | |
| 9,986,849 | B2 * | 6/2018 | Sclare | A47D 9/016 | |
| 11,116,330 | B2 * | 9/2021 | Tully | A47D 9/012 | |
| 2003/0112147 | A1 * | 6/2003 | George | A61B 5/4824 | 340/691.6 |
| 2005/0241064 | A1 * | 11/2005 | Lopes | A47D 9/016 | 5/655 |
| 2010/0263121 | A1 * | 10/2010 | Arnold, IV | A47D 9/016 | 5/98.1 |
| 2012/0017369 | A1 * | 1/2012 | Li | A47D 9/02 | 5/93.1 |
| 2013/0185867 | A1 * | 7/2013 | Long | A47D 13/08 | 5/100 |
| 2014/0208505 | A1 * | 7/2014 | Burkholder | A47D 7/002 | 5/99.1 |

(Continued)

OTHER PUBLICATIONS

Owner's manual for Halo BassiNest Swivel Sleeper, 20 pages, dated Oct. 3, 2019.

*Primary Examiner* — George Sun
(74) *Attorney, Agent, or Firm* — Merchant & Gould P.C.

(57) ABSTRACT

An infant sleep device that is provided with a number of unique features to improve the functionality of the infant sleep device as well as improve the caregiver experience with the infant sleep device. The infant sleep device may be a bassinet-like device.

20 Claims, 20 Drawing Sheets

(56) References Cited

U.S. PATENT DOCUMENTS

| | | | | |
|---|---|---|---|---|
| 2016/0309912 | A1* | 10/2016 | Long | A47D 9/012 |
| 2018/0035821 | A1* | 2/2018 | Bass-Conn | A47D 9/00 |
| 2019/0254443 | A1* | 8/2019 | Longenecker | A47D 9/012 |
| 2021/0275935 | A1* | 9/2021 | Fornell | A47D 9/00 |
| 2022/0007851 | A1* | 1/2022 | Goldsmith | A47D 9/012 |
| 2024/0000241 | A1* | 1/2024 | Cheng | A47D 13/02 |

* cited by examiner

INFANT SLEEP DEVICE

FIELD

This technical disclosure relates to an infant sleep device including, but not limited to, a bassinet-like device. The infant sleep device is constructed with a number of features that improve the function of and caregiver experience with the infant sleep device.

BACKGROUND

Infant sleep devices in the form of bassinet-like devices are disclosed in U.S. Pat. Nos. 8,429,771 and 9,962,012.

SUMMARY

Infant sleep devices are described herein that are provided with a number of unique features to improve the functionality of the infant sleep devices as well as improve the caregiver experience with the infant sleep devices. The infant sleep devices are described and illustrated herein as being bassinet-like devices. However, the unique features described herein can be used individually or in any combination thereof on infant sleep devices other than bassinet-like devices. In addition, the unique features described herein may be used individually or in any combination thereof on a bassinet-like device.

In one embodiment, the sleep surface or base surface of the infant sleep device is formed by a plastic, open-grid structure that is rigid yet lightweight, easy to clean, and breathable. The sleep surface may be non-removably mounted to a support base or the sleep surface may be attached to the support base in a manner to permit the sleep surface to be removable as well as allow the sleep surface to be attached to the support base in a number of rotational orientations when viewing the sleep surface in a top view or a bottom view. However, other designs of the sleep surface are possible. In addition, the sleep surface can be used as a sleep surface both when the sleep surface is attached to the support base and when the sleep surface is detached from the support base.

In another embodiment, the infant sleep device can include one or more clips, for example two or more clips, that are configured to removably clip lower edges of a sidewall structure of the infant sleep device to the sleep surface. Upper edges of the sidewall structure may also be removably attached to upper support structures of the infant sleep device. When the sidewall structure is attached, the sidewall structure forms an enclosure to help retain an infant in the sleep area of the infant sleep device. However, the sidewall structure can be removed for cleaning or replacement.

The support base of the infant sleep device that supports the sleep surface in a raised position above the floor is also unique. The support base includes a plurality of support legs, for example three or four or more support legs, with each leg having a first end that engages the floor and a second end raised a distance above the floor and connected to a central hub. A support pole is supported by the central hub and an upper end of the support pole supports the sleep surface of the infant sleep device. An adjustment mechanism may be provided on the central hub that allows the support pole to be vertically adjusted relative to the central hub, thereby adjusting the height of the sleep surface. However, other designs of the base that supports the sleep surface are possible.

In another embodiment, a sidewall of the infant sleep structure can be raised and lowered, with the sidewall being biased upwardly to the raised position. A lock mechanism can be provided to temporarily lock the sidewall in the lowered position against the upward biasing force. When the lock mechanism is released, the sidewall is automatically returned to the raised position. The sidewall may also include a releasable lock mechanism to hold the sidewall in the raised position until the lock mechanism is released allowing the sidewall to be lowered to the lowered position. An example of an infant sleep structure with a releasable lock mechanism holding a sidewall in a raised position is disclosed in U.S. 2022/0007851, the entire contents of which are incorporated herein by reference.

DRAWINGS

Figure 10A:
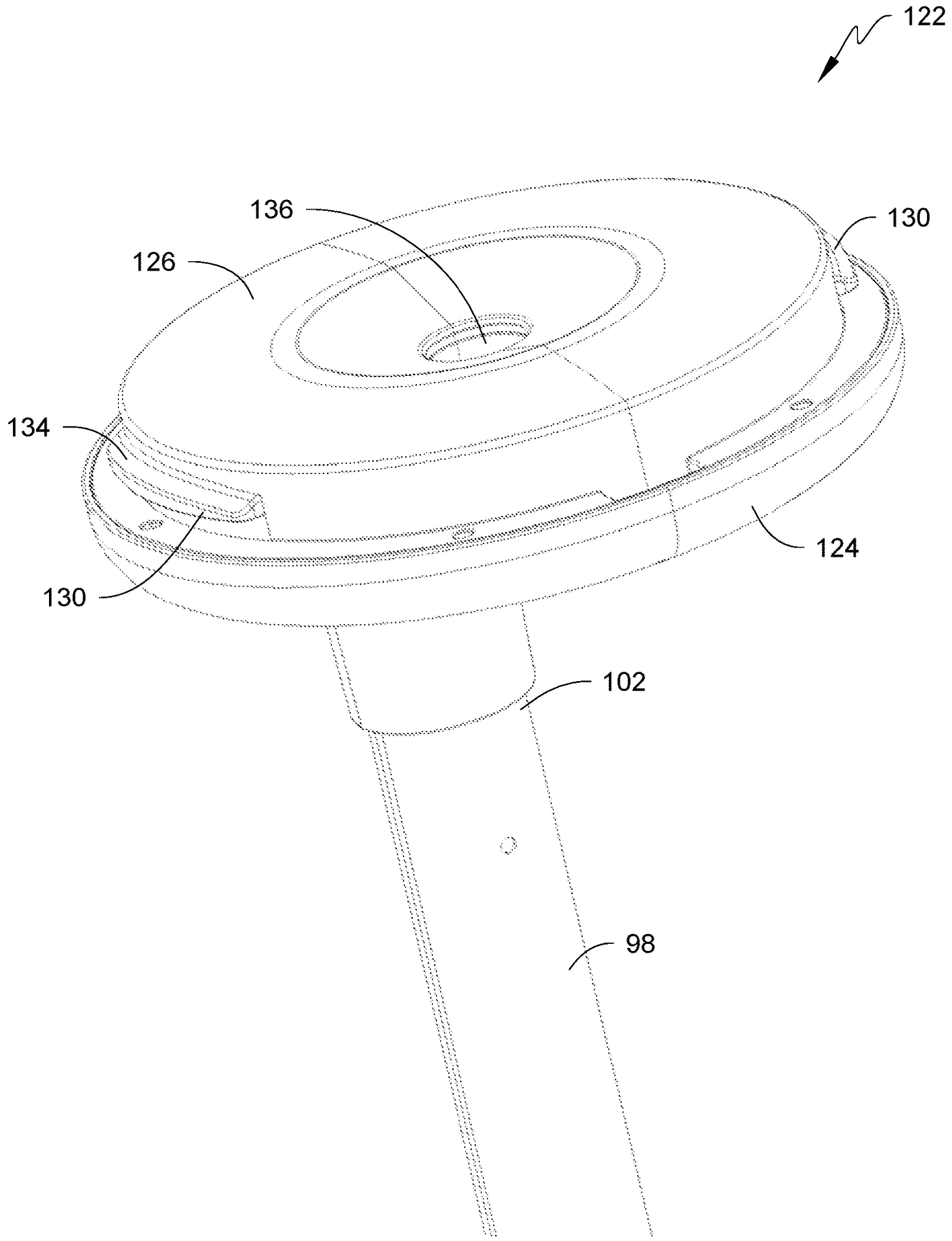
Figure 10B:
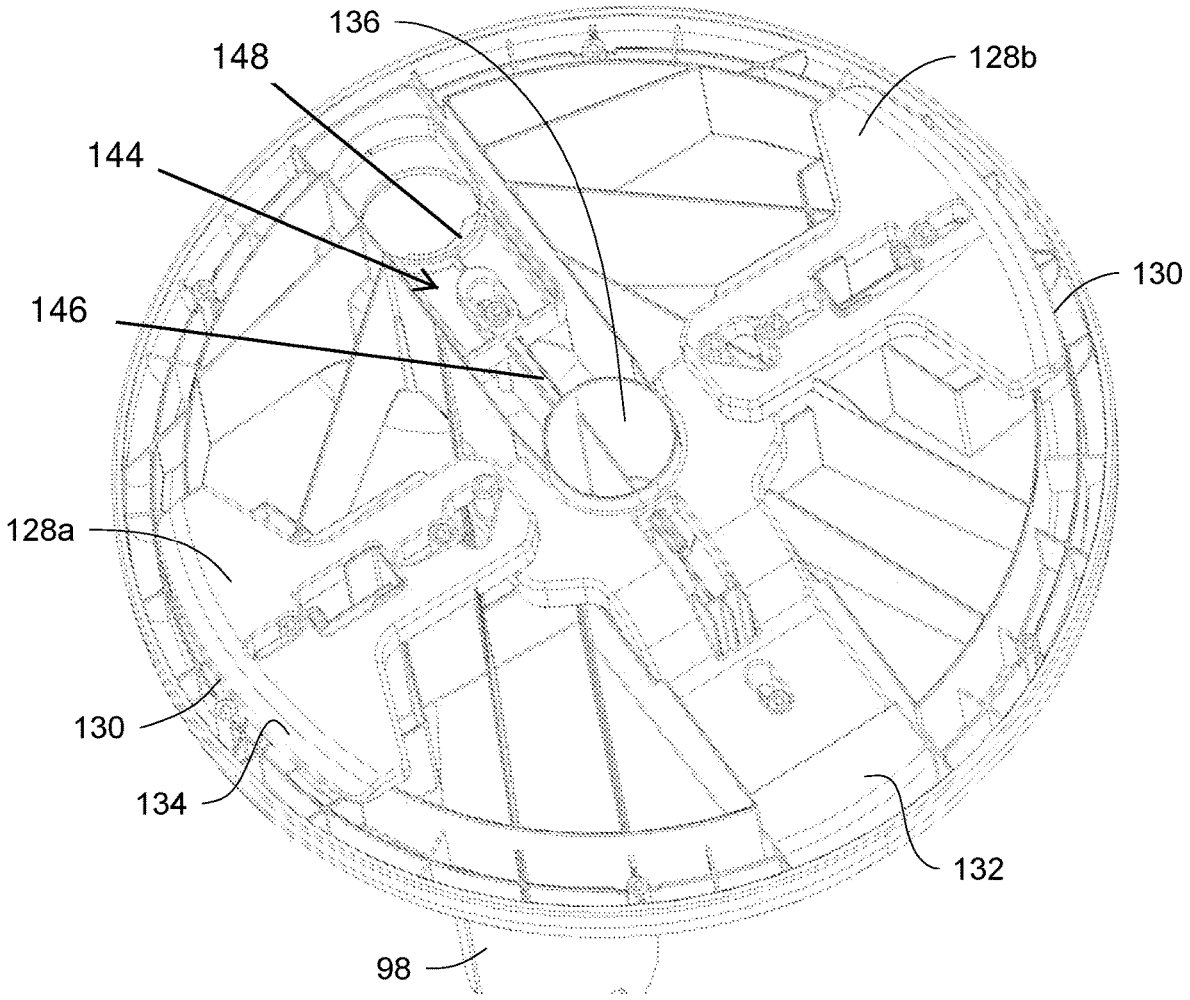
Figure 10C:
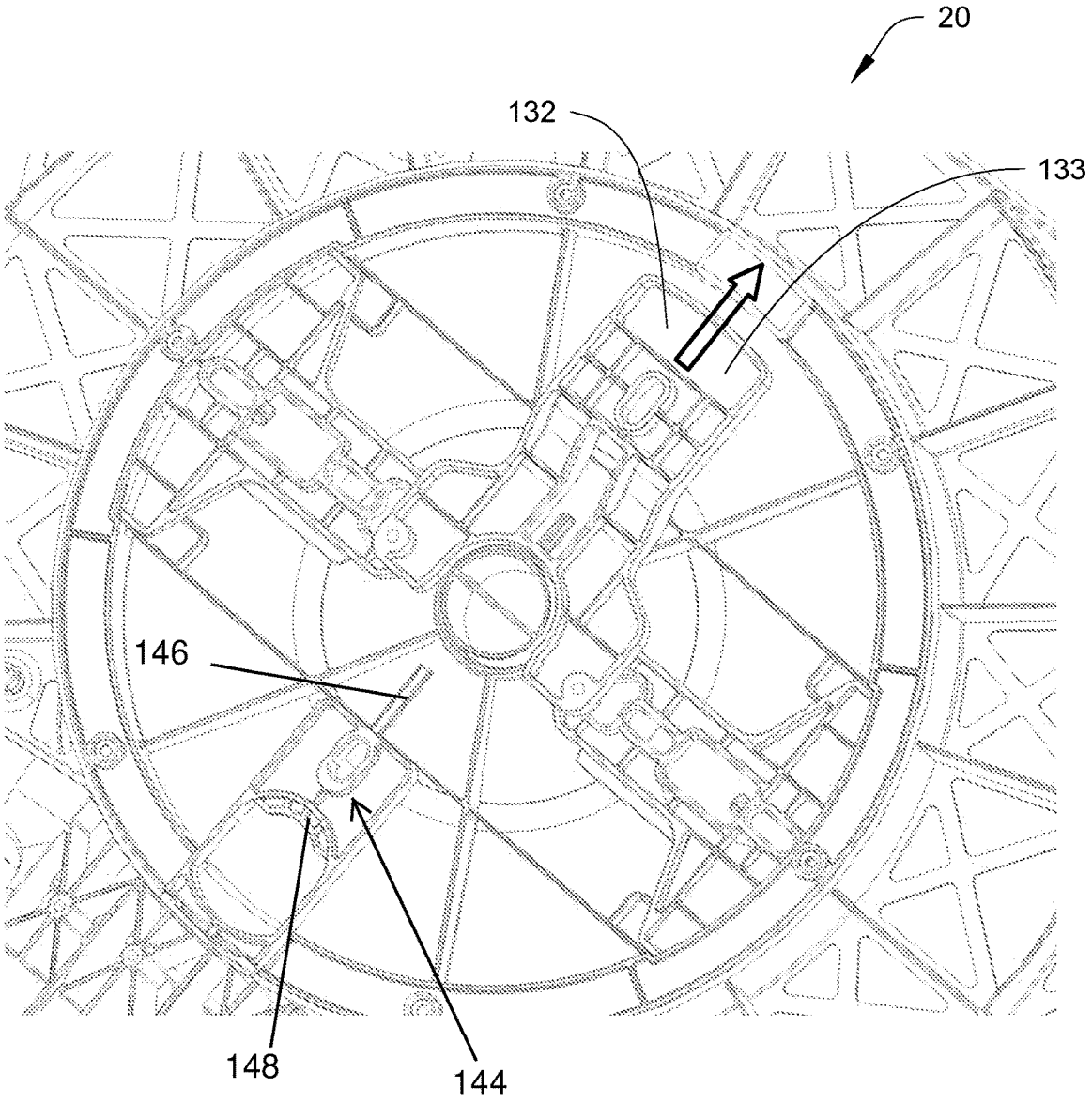

FIGS. 10A, 10B and 10C are detailed views of a sleep surface connector at the upper end of the support pole that removably attaches to the sleep surface, with FIG. 10A being a perspective view, FIG. 10B showing the sleep surface connector with an upper cover thereof removed to depict interior components, and FIG. 10C being a bottom view of the sleep surface connector with a bottom wall thereof removed to depict interior components.

Figure 11:
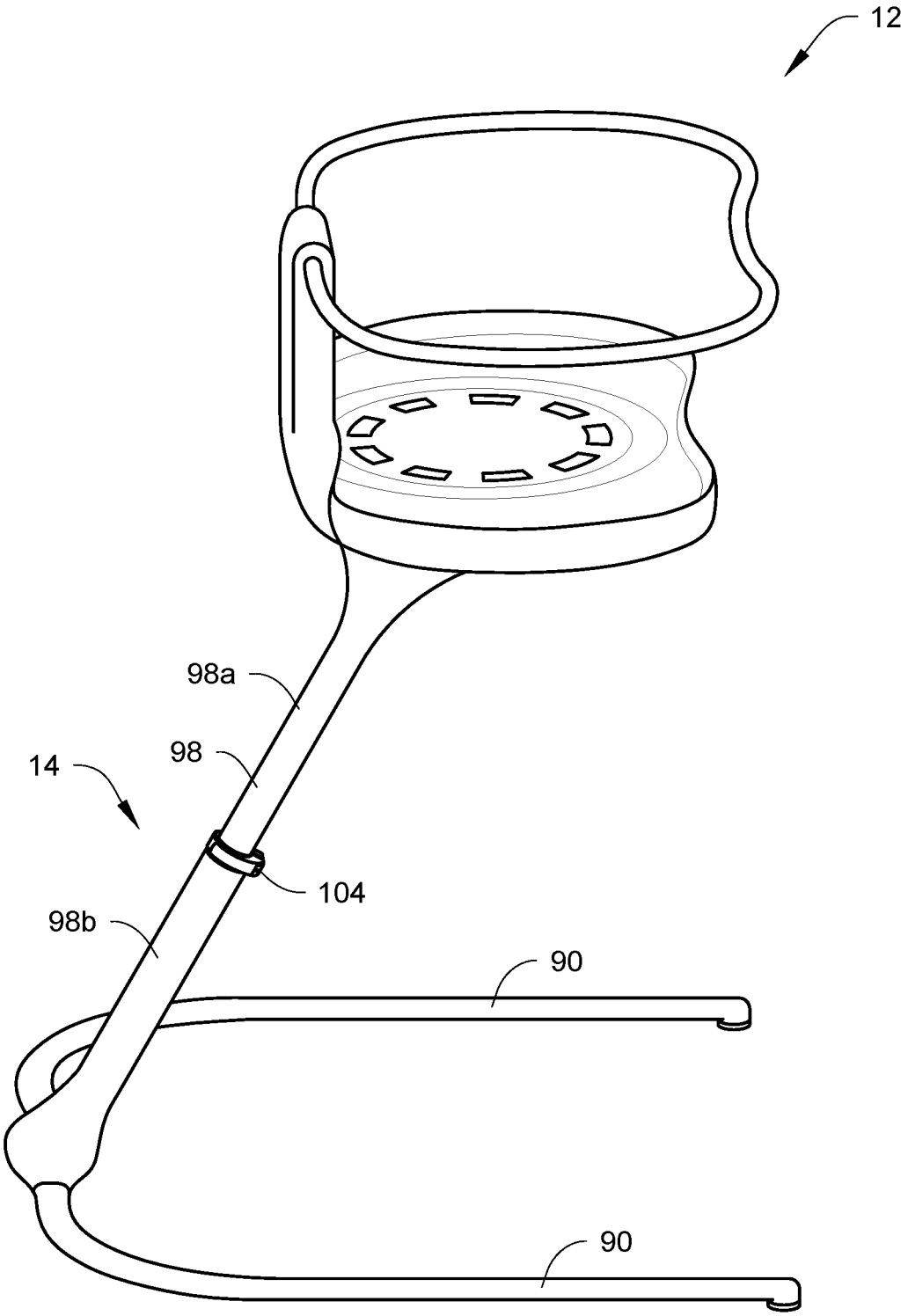

FIG. 11 depicts another example of a support base that can be used with the infant sleep structure.

Figure 12A:
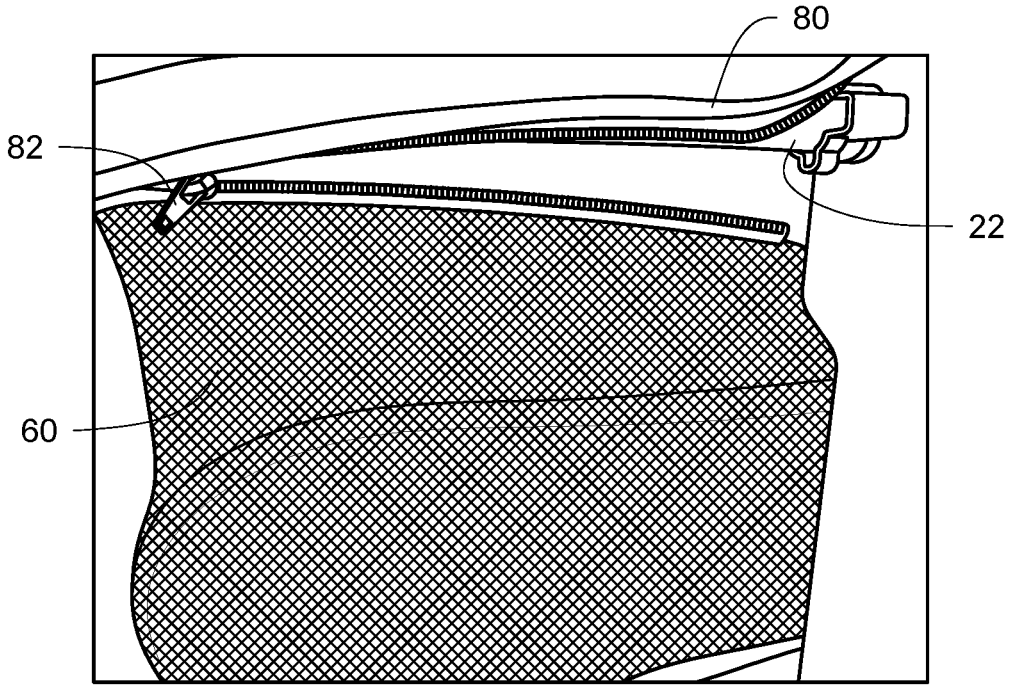
Figure 12B:
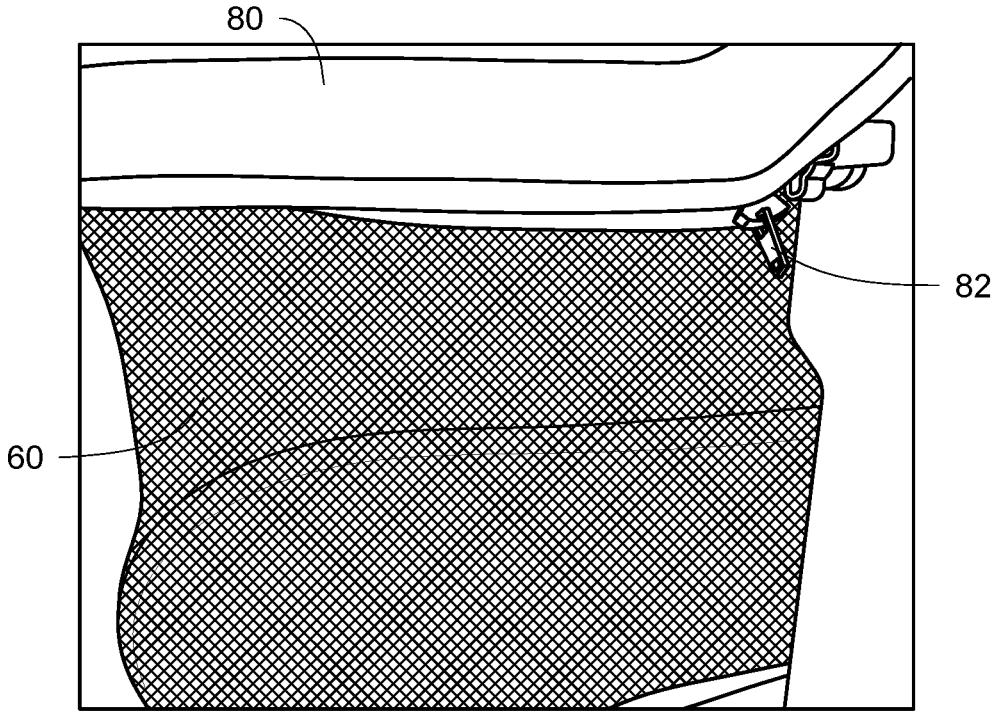
Figure 12C:
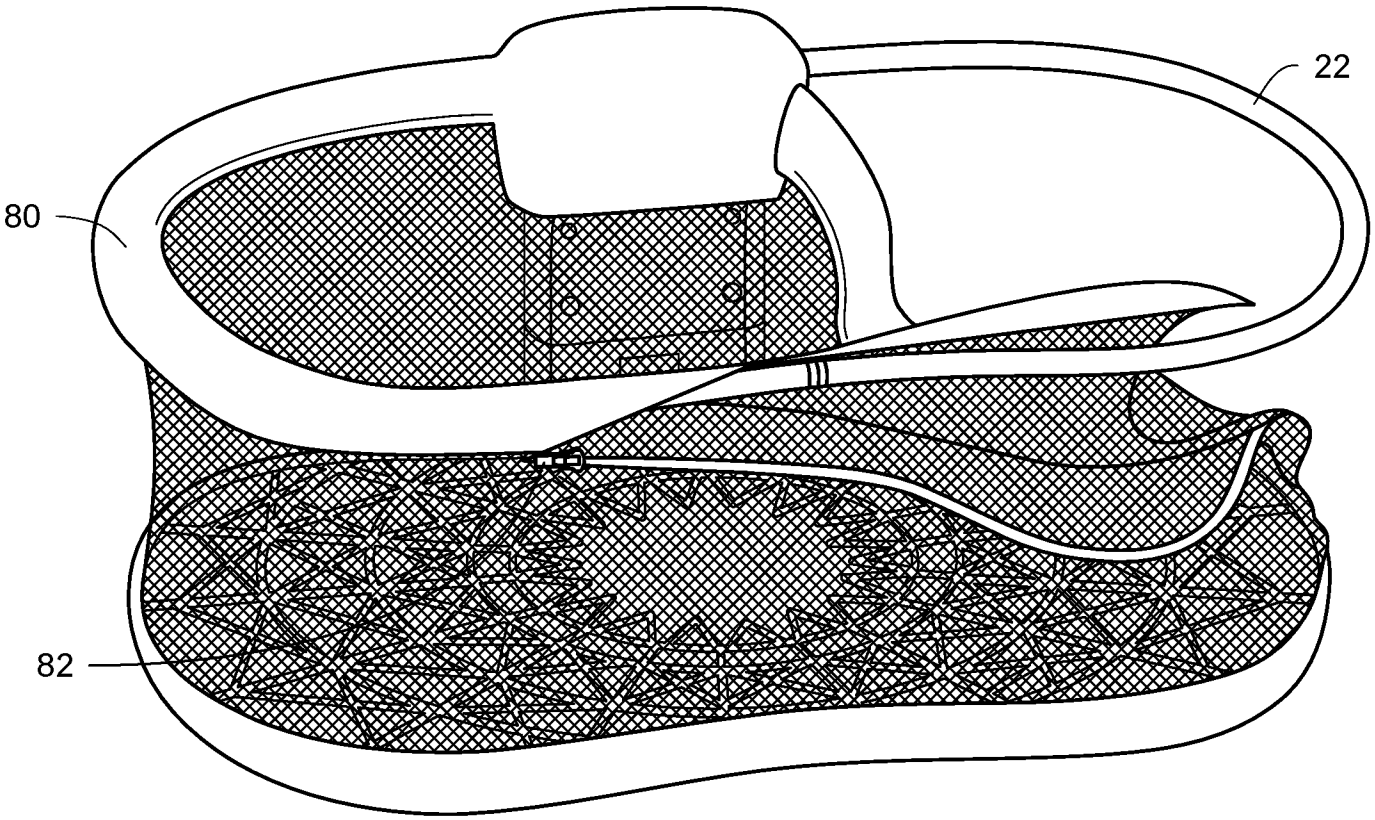

FIGS. 12A, 12B and 12C depict removable attachment of upper edges of the sidewall structure to upper support structure of the infant sleep device.

Figure 13:
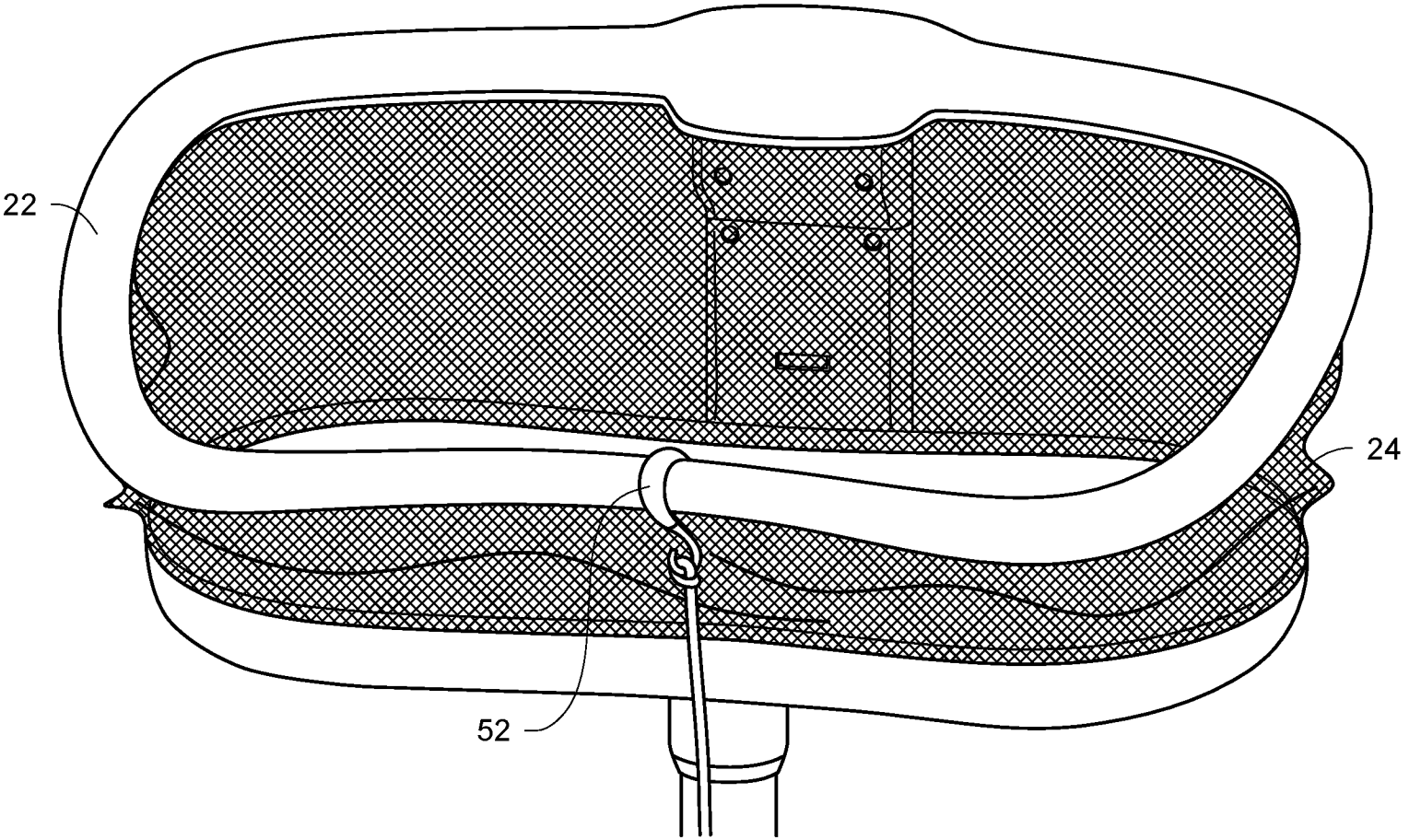

FIG. 13 depicts an example of a locking mechanism to temporarily lock the sidewall structure in a lowered position.

Figure 9A:
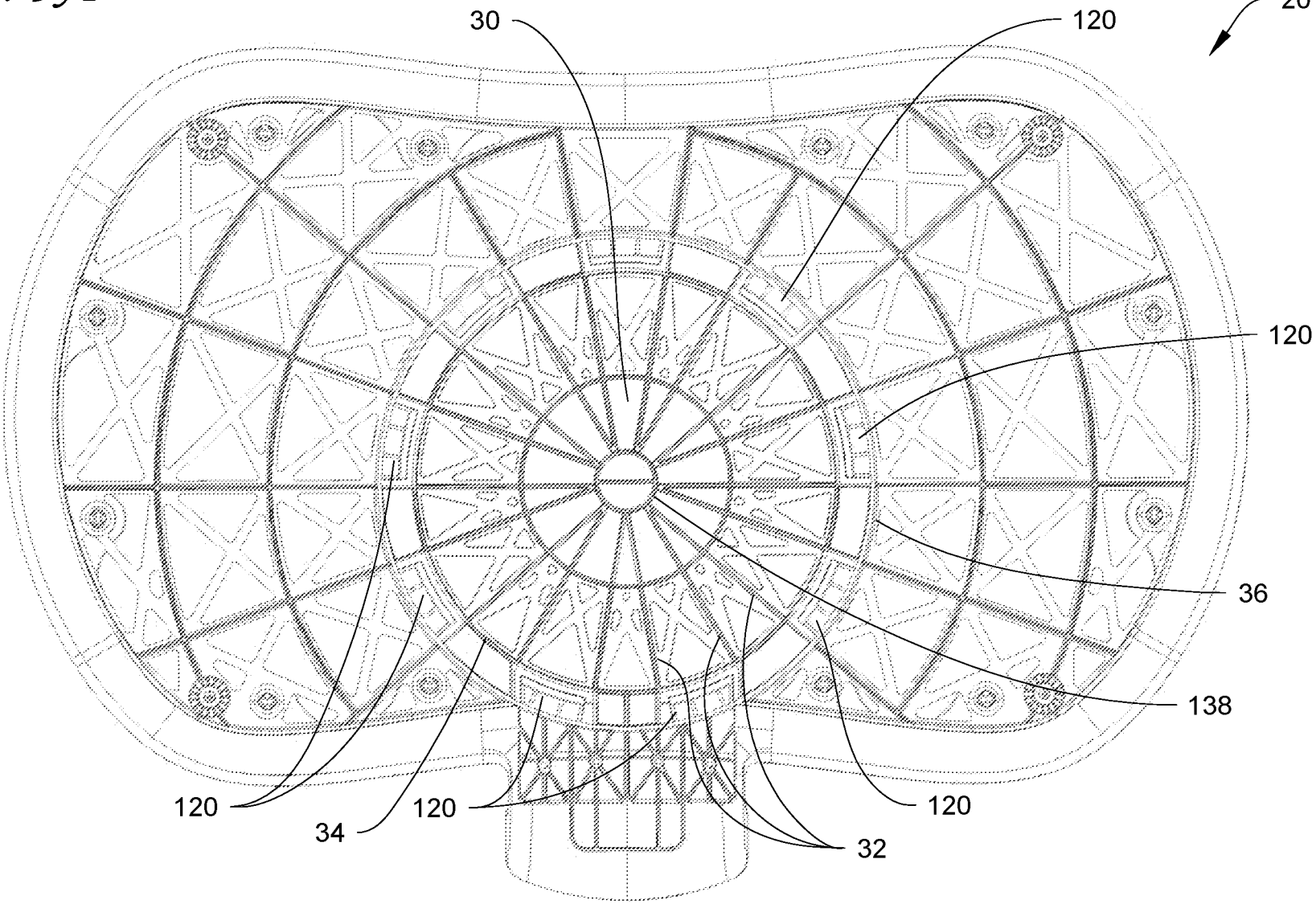
FIGS. 9A and 9B are close-up views of a portion of the bottom of the sleep surface.
Figure 9B:
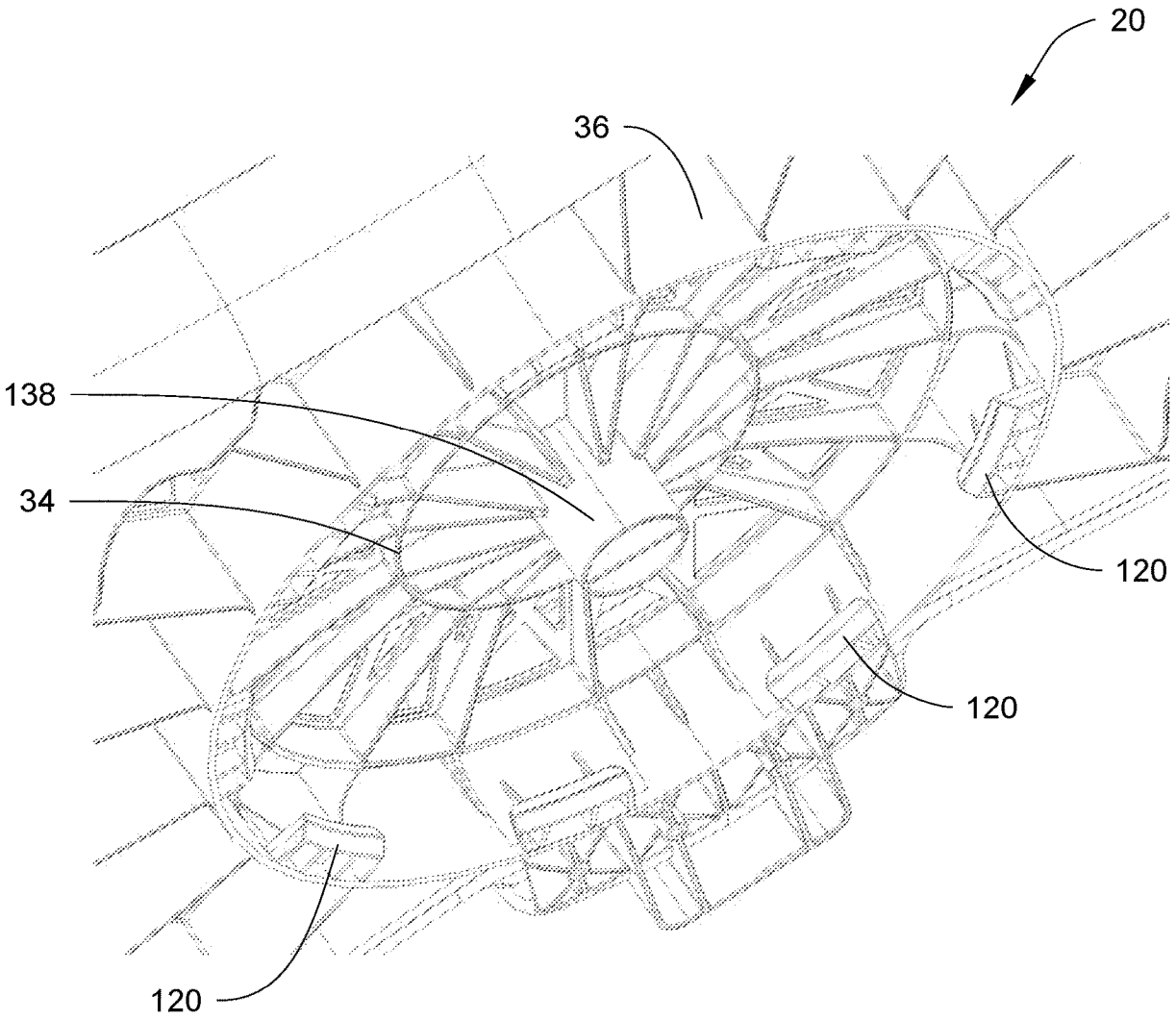
Figure 14:
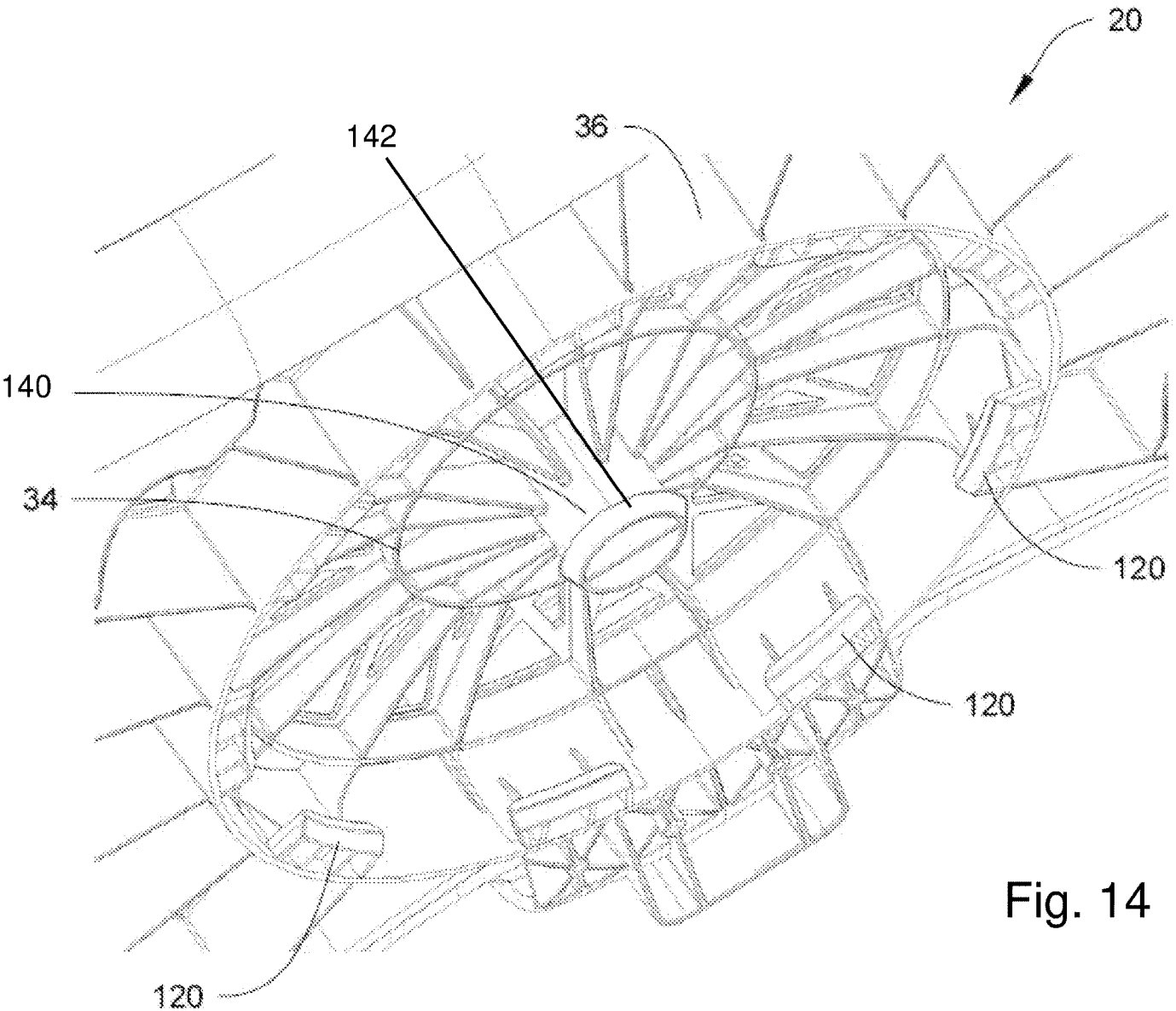

FIG. 14 is a view similar to FIG. 9B showing how the sleep enclosure portion can be modified for use in another embodiment of a detachable connection between the sleep enclosure portion and the support base.

Figure 15:
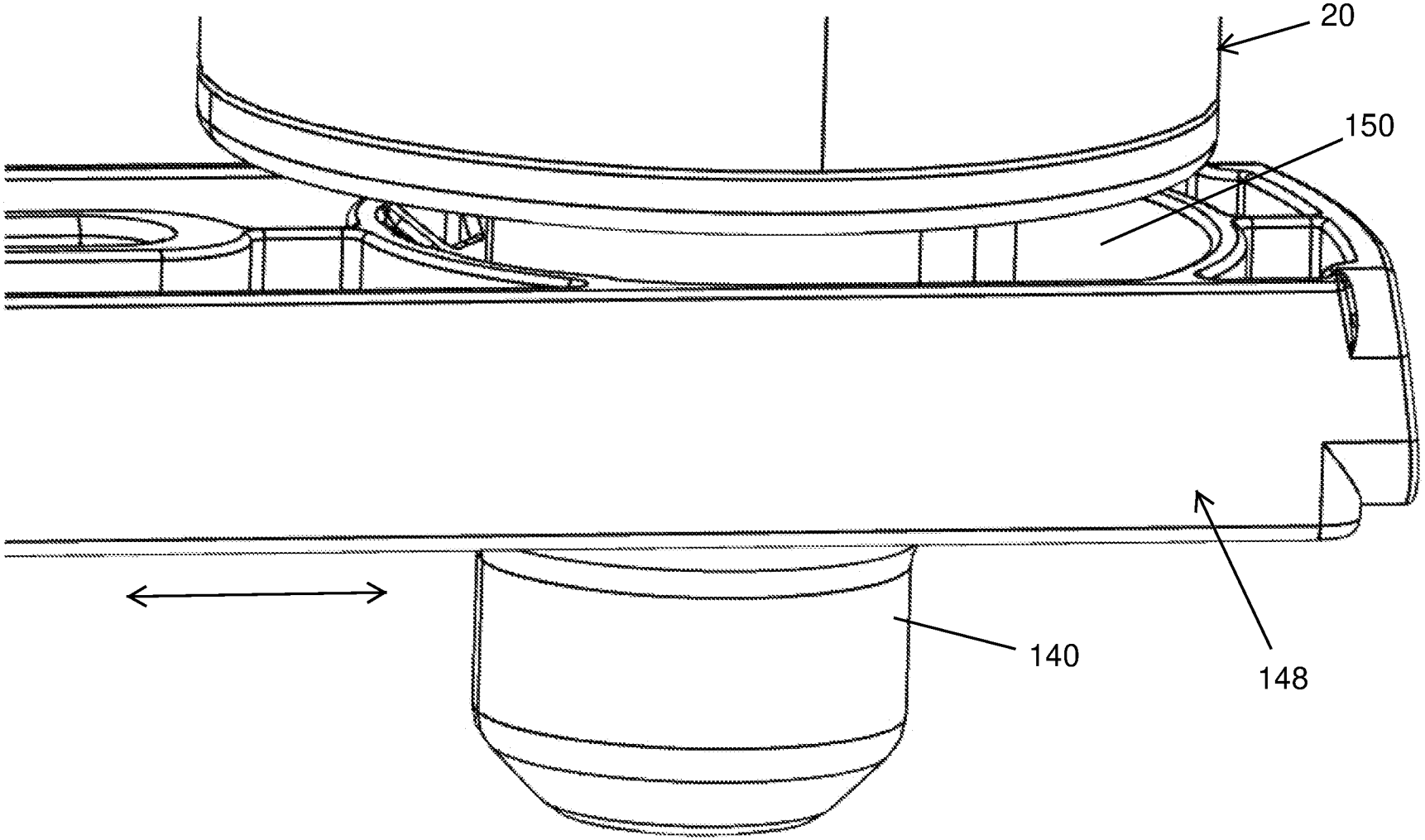

FIG. 15 is a close-up view of a slide mechanism of the detachable connection that can be used with the modified sleep enclosure portion in FIG. 14.

Figure 16:
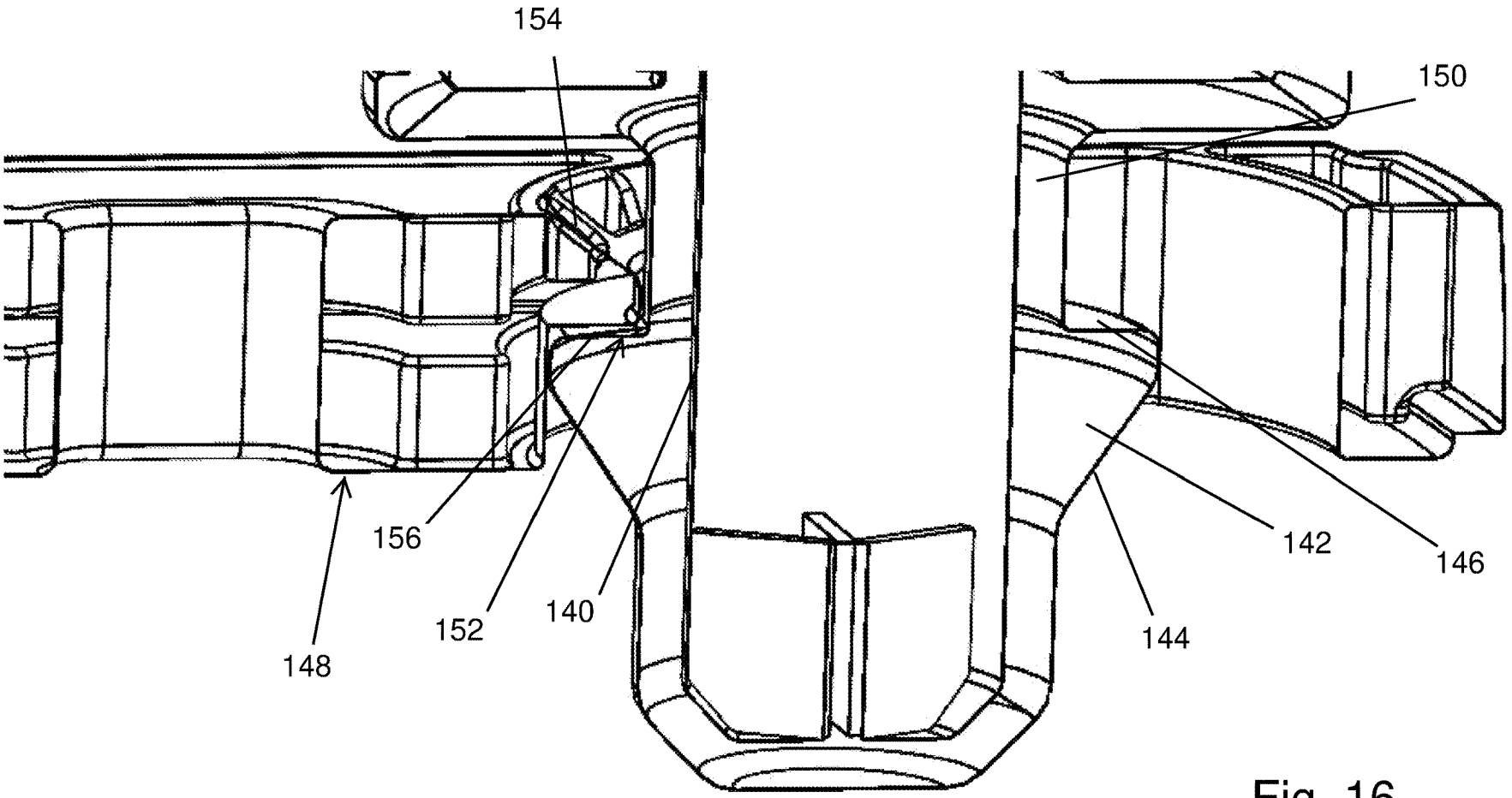

FIG. 16 is a cross-sectional view through the slide mechanism of FIG. 15.

DETAILED DESCRIPTION

Figure 1:
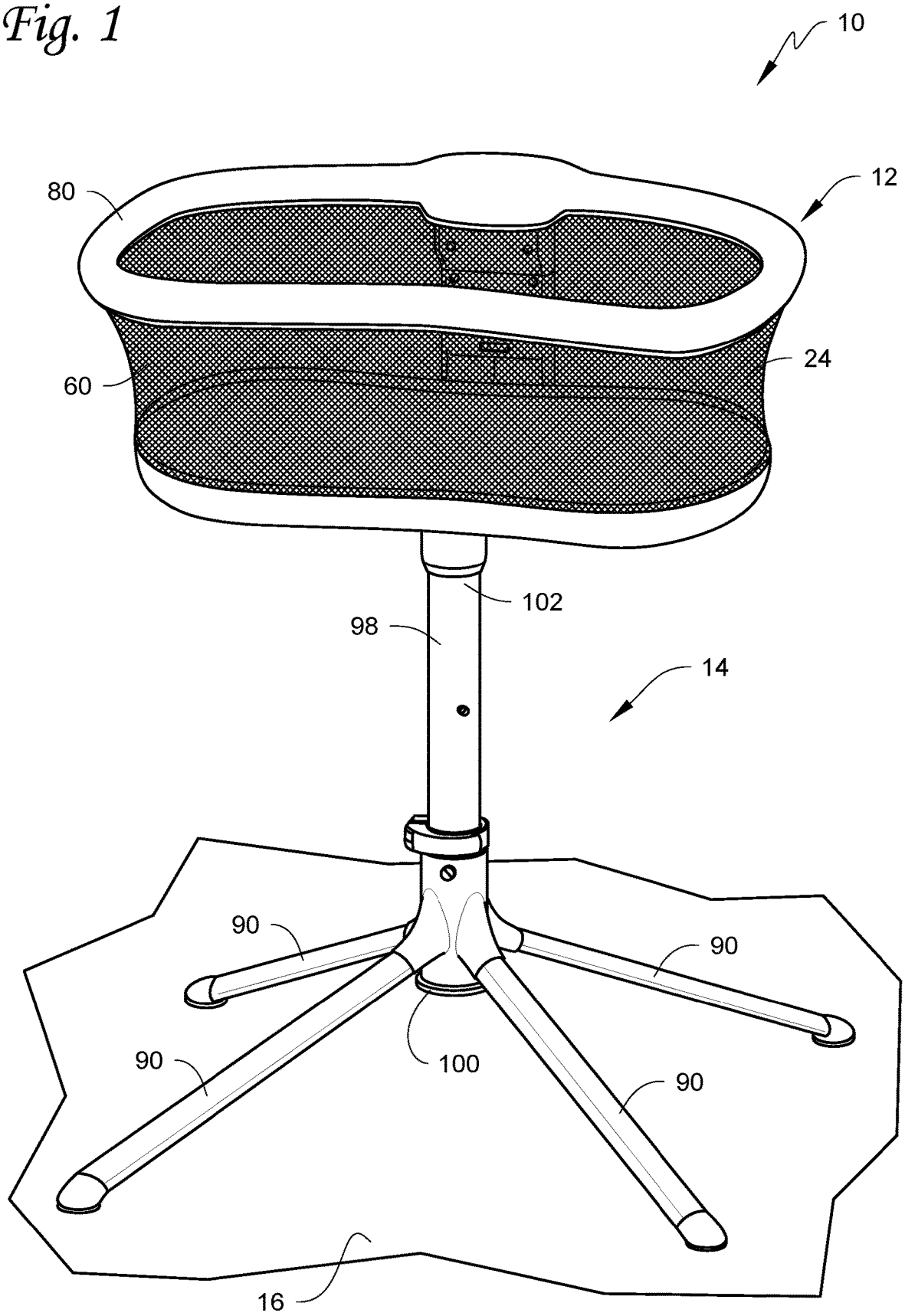
FIG. 1 is a perspective view of an infant sleep device described herein.

FIG. 1 depicts an example of an infant sleep device 10 described herein. The infant sleep device 10 is depicted as including a sleep enclosure portion 12 in which an infant sleeps, and a support base 14 that supports the sleep enclosure portion 12 a distance above the floor 16. In this example, the infant sleep device 10 is depicted as a bassinet-like device. However, the unique features described herein can be used on other infant sleep devices.

Figure 2:
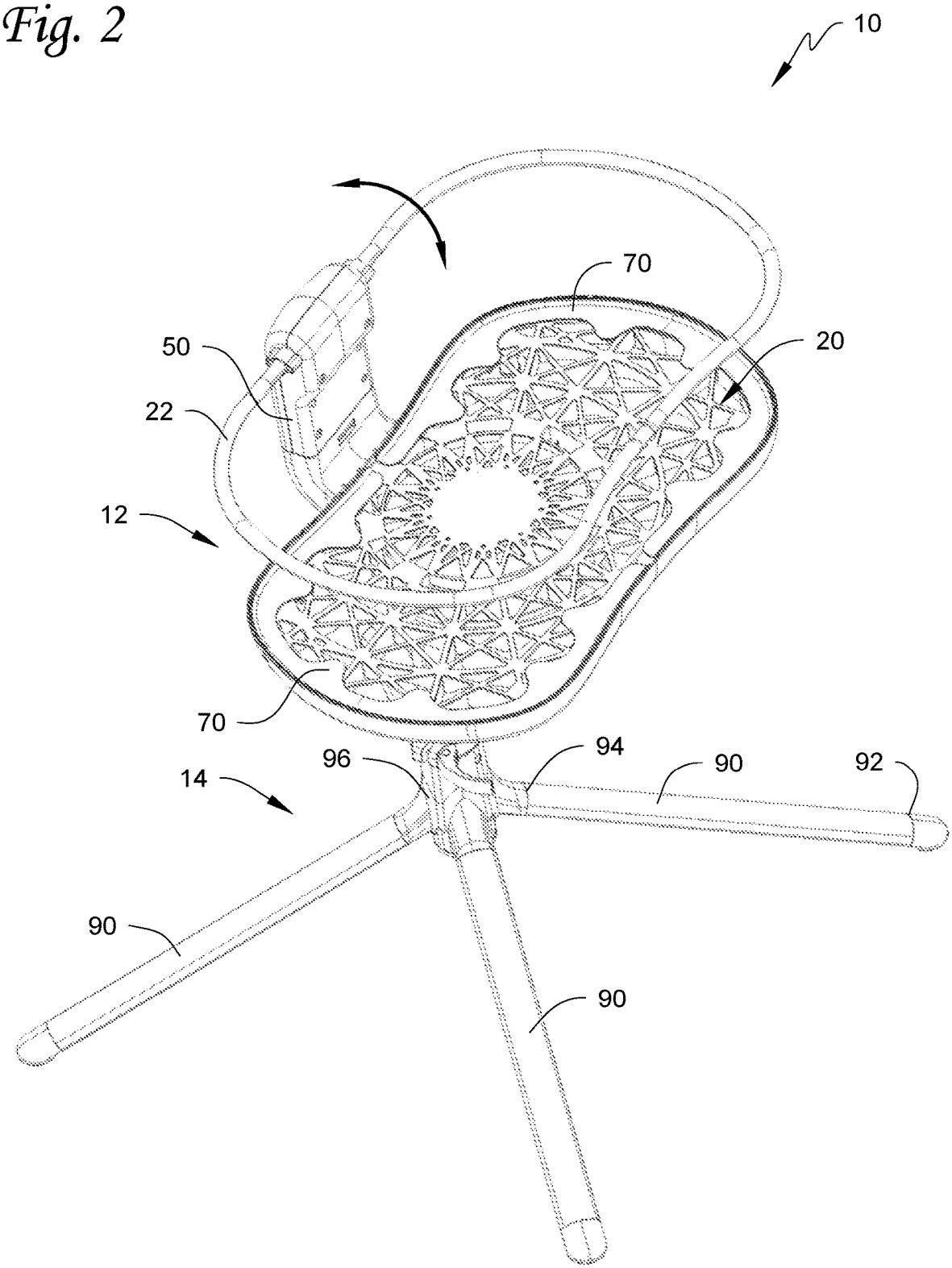
FIG. 2 is a perspective view of the infant sleep device with the sidewall structure removed.

Referring to FIGS. 1 and 2, the sleep enclosure portion 12 includes a sleep surface 20, an upper support rail 22 (or just upper support 22), and a sidewall structure 24 that extends between the sleep surface 20 and the upper support rail 22 to define an enclosed area in which an infant sleeps. As described in further detail below, the sidewall structure 24 is removably attached to the sleep surface 20 and to the upper support rail 22 to allow removal of the sidewall structure 24 for laundering or replacement. Some or all of the sidewall structure 24 can be formed of mesh material to allow viewing of the interior of the sleep area. A mattress/pad (not shown) is disposed on the upper surface of the sleep surface 20 to provide a soft surface on which the infant lays during use.

Figure 3:
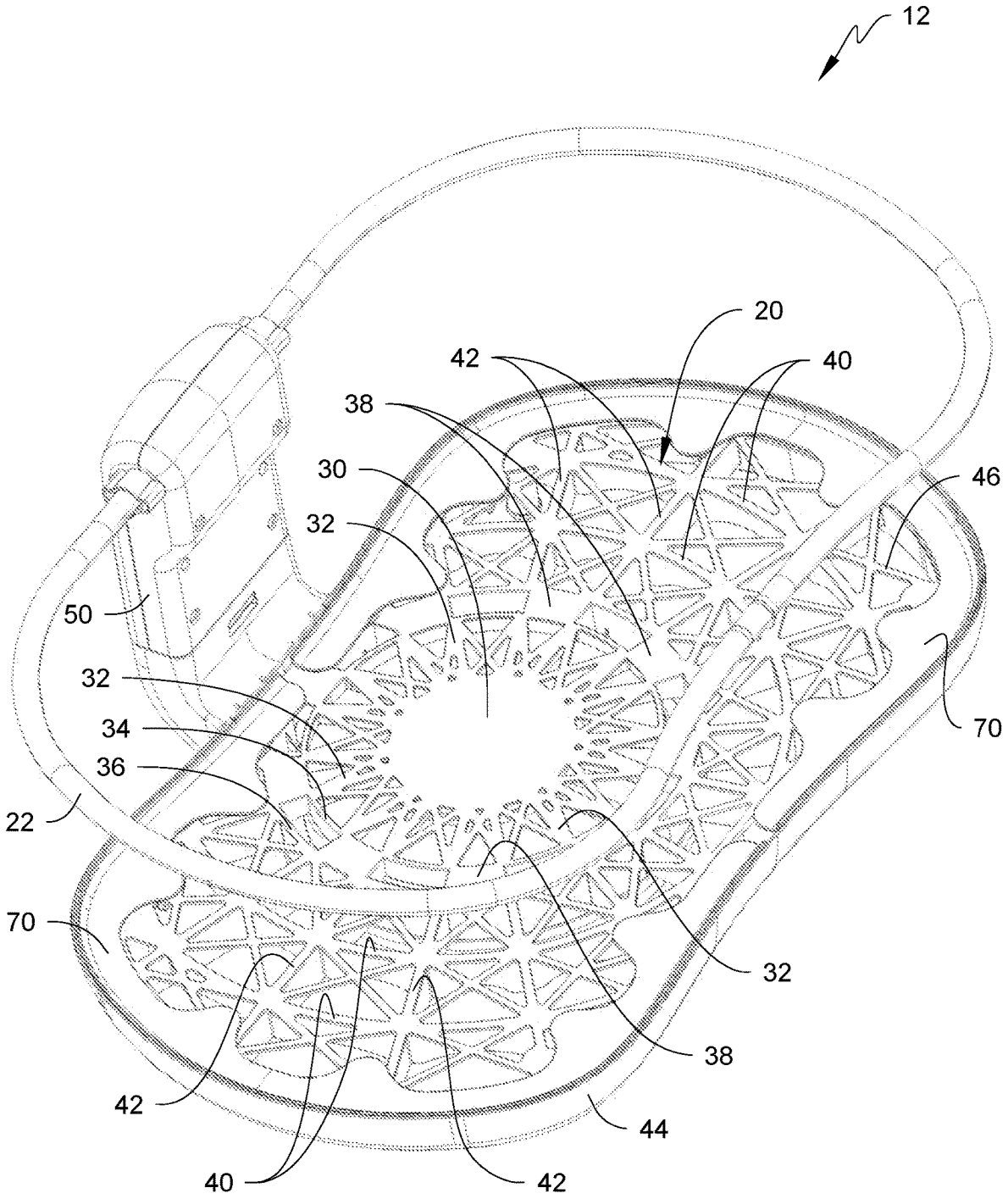
FIG. 3 is a close-up top perspective view of the sleep surface of the infant sleep device.
Figure 4:
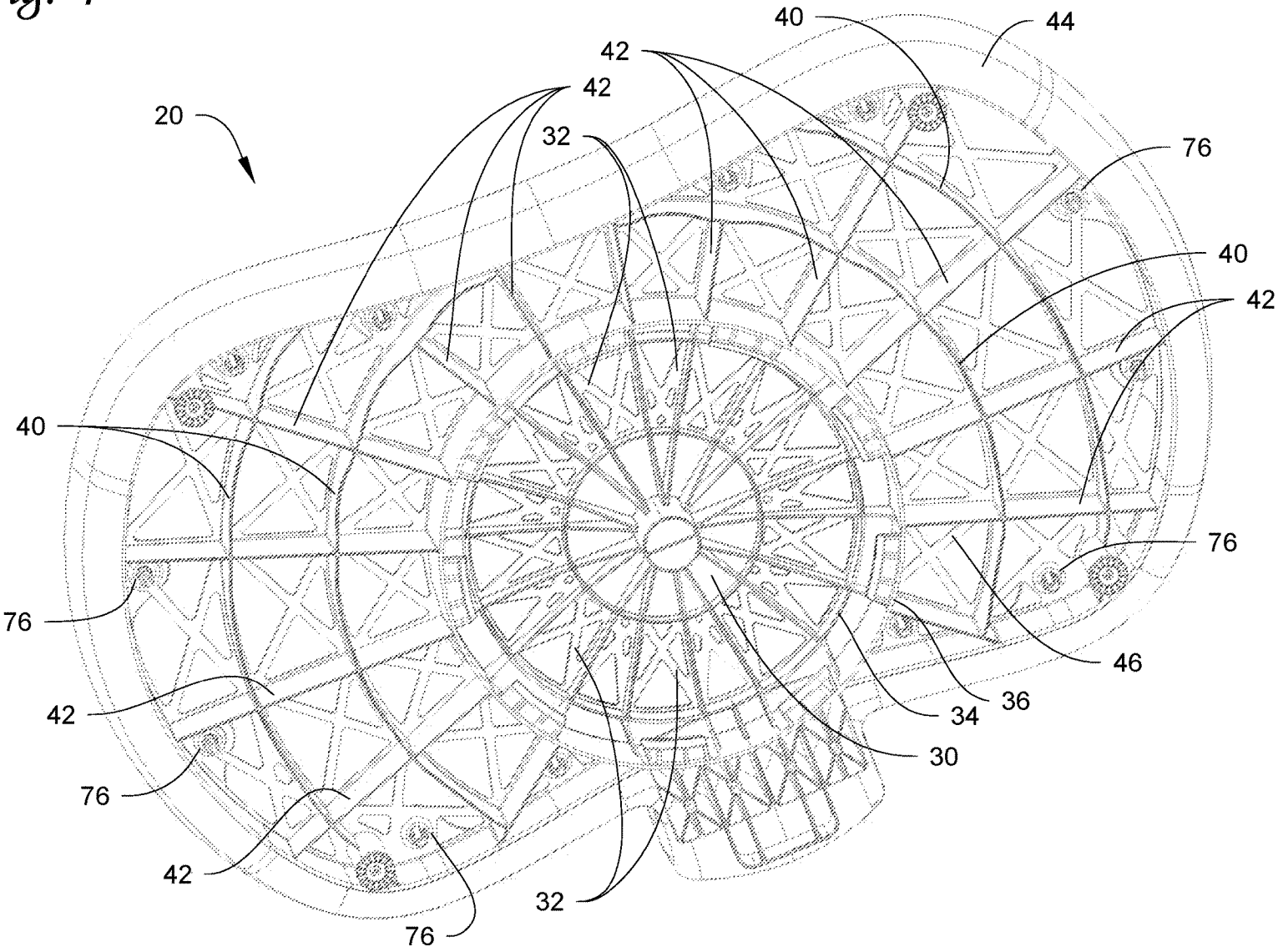
FIG. 4 is a bottom perspective view of the sleep surface removed from the infant sleep device.

Referring to FIGS. 2-4, the sleep surface 20 comprises a plastic open-grid, rigid support structure that can be described as being foraminous or having a number of openings. The sleep surface 20 comprises a solid portion 30 that is devoid of openings. A plurality of circumferentially spaced ribs 32 extend outwardly from the solid portion 30 whereby the solid portion 30 and the ribs 32 together generally define the appearance of a sunburst. A first or inner ring 34 connects to the tips of the ribs 32, and a second or outer ring 36 surrounds the first/inner ring 34 and is connected thereto by ribs 38. The sleep surface 20 further includes a series of arcuate, radially spaced ribs 40 and a series of radial ribs 42 that extend from the second/outer ring 36, to the ribs 40, and to a perimeter rim 44. The intersection points between the second/outer ring 36, the ribs 40 and the ribs 42 can be described as nodes, and stiffening ribs 46 that are arranged into an X-shape are provided in the openings defined between the second/outer ring 36, the ribs 40, the ribs 42 and the perimeter rim 44. The construction of the sleep surface 20 provides a number of advantages including providing a rigid yet lightweight structure, easy cleanability, and being breathable due to the open-grid, foraminous structure that allows air flow through the openings in the sleep surface 20.

Returning to FIGS. 2 and 3, an arm 50 is connected to and extends upwardly from the sleep surface 20. The upper support rail 22 extends through and is supported by the upper end of the arm 50. Preferably the upper support rail 22 is rotatably supported by the arm 50 to allow the upper support rail 22 to rotate downward from the raised position shown in FIGS. 1-3 to a lowered position (FIG. 13) when a downward force is applied to the upper support rail 22. It is also preferred that a biasing mechanism is provided in the arm 50 that applies a biasing force to the upper support rail 22 to bias the upper support rail 22 toward the raised position shown in FIGS. 2-3. Further information on lowering side walls and automatic biasing of side walls to a raised position are disclosed in U.S. Pat. Nos. 8,429,771 and 9,962,012 each of which is incorporated herein by reference in their entirety.

With reference to FIG. 13, in some embodiments a lock mechanism 52 can be provided to temporarily lock the upper support rail 22 and therefore the sidewall structure 24 in the lowered position, and when the lock mechanism 52 is released the biasing force acting on the upper support rail 22 automatically raises the upper support rail 22 and the sidewall structure 24 back to the raised position. The lock mechanism 52 is depicted as being a manually actuated hook structure fixed to the sleep surface or other structure of the infant sleep device 10 that can hook over the upper support rail 22 to retain the sidewall structure 24 at the lowered position. However, the lock mechanism 52 can have any construction that can releasably lock the upper support rail 22 in the lowered position and that can be released to allow the sidewall structure to be automatically biased back to the raised position.

Figure 5:
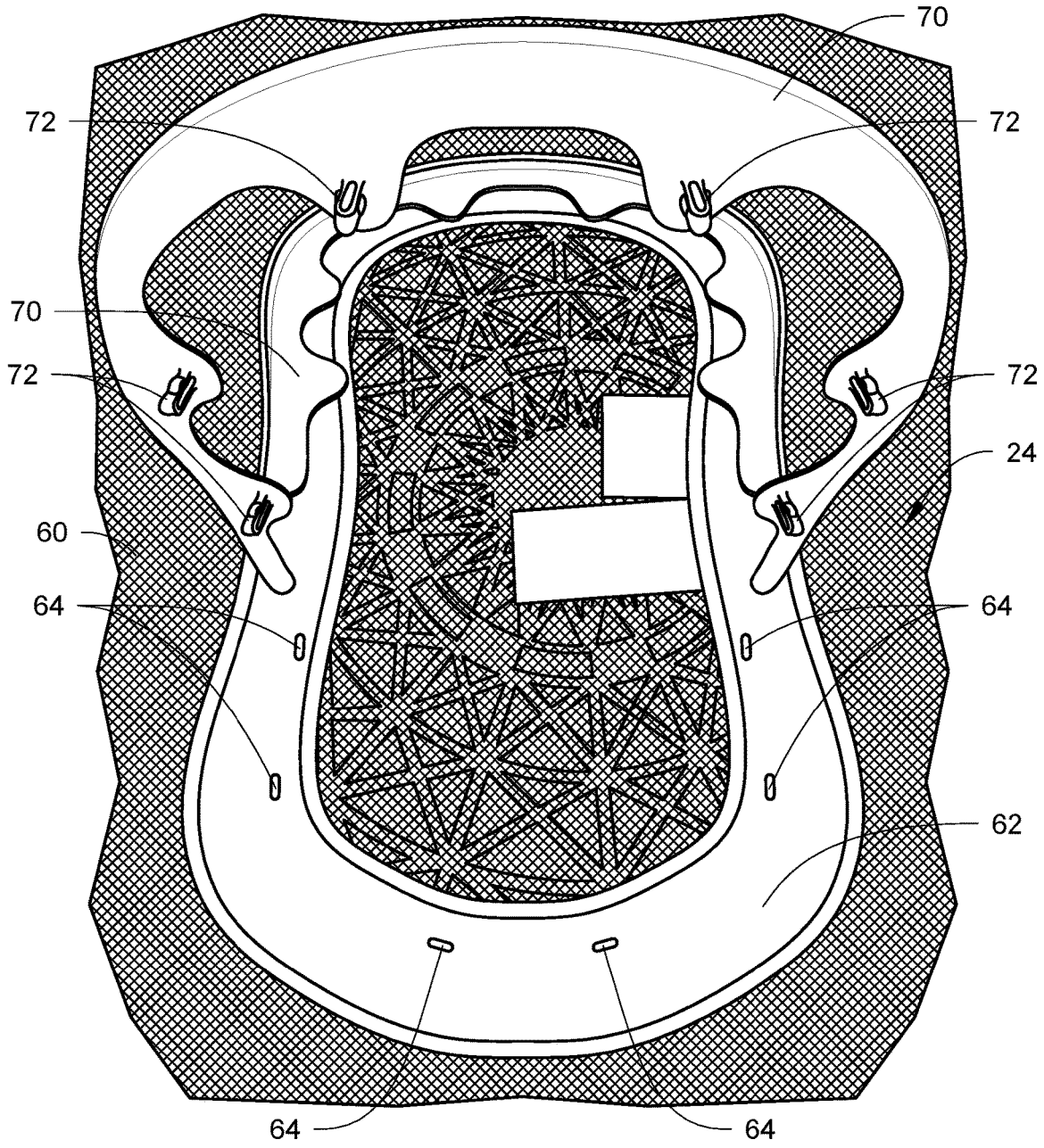
FIG. 5 depicts clips that removably secures lower edges of the sidewall structure to the sleep surface of the infant sleep device.
Figure 6:
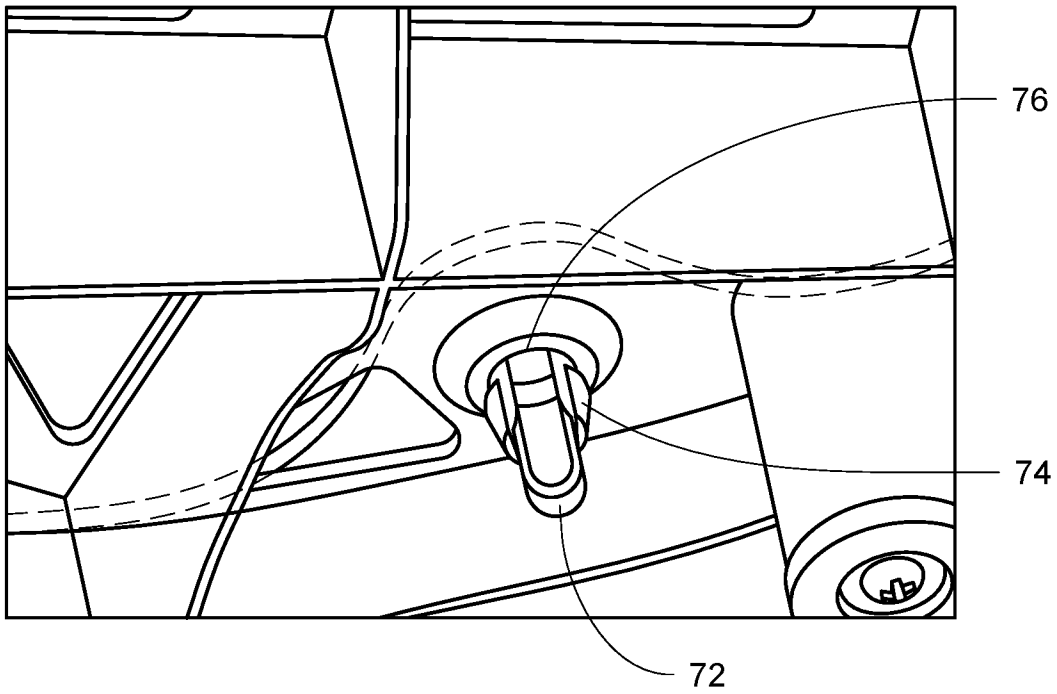
FIG. 6 is a detailed view of a peg of one of the clips extending through a hole in the sleep surface while securing the lower edges of the sidewall structure.
Figure 7A:
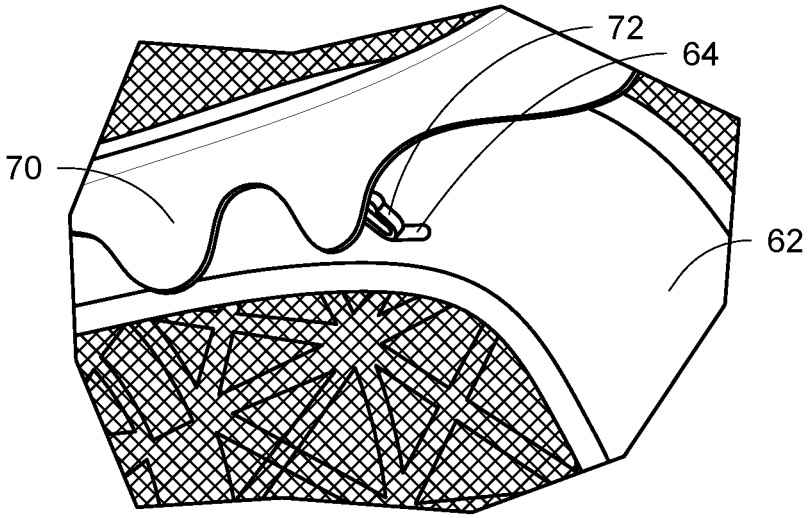
FIGS. 7A and 7B depict operation of one of the clips and associated pegs in securing the lower edges of the sidewall structure to the sleep surface.
Figure 7B:
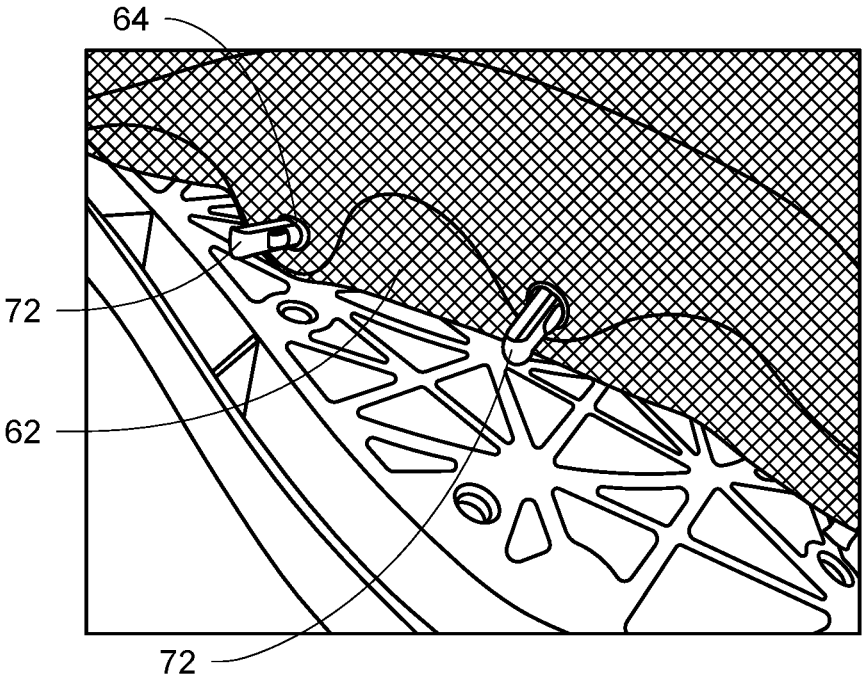

As mentioned above, the sidewall structure 24 is removably attached to the sleep surface 20 and to the upper support rail 22 to allow removal of the sidewall structure 24 for laundering or replacement. Referring to FIGS. 1, 5, 7A, 7B, and 14A-C, the sidewall structure 24 includes a mesh sidewall portion 60 that defines the sidewall of the sleep enclosure portion 12. The mesh sidewall portion 60 includes lower edges 62 (which may also be considered a single lower edge 62) that at least partially overlaps the upper surface of the sleep surface 20. FIG. 5 depicts the base of the sidewall structure 24 as being continuous and overlapping the entire area of the sleep surface 20. However, the base of the sidewall structure 24 need not be continuous and the base can have a hole so that only a portion of the sleep surface 20 is overlapped by the lower edge 62 of the sidewall structure 24. As best seen in FIGS. 5, 7A and 7B, the portion of the lower edges 62 that overlap the sleep surface 20 include a plurality of holes 64 formed therethrough. The holes 64 may be reinforced by stitching or by use of grommets.

Referring to FIGS. 2-3, 5-6, 7A and 7B, one or more clips 70 are provided to removably attach the lower edges 62 of the sidewall structure 24 to the sleep surface 20. The illustrated example shows the use of two of the clips 70 each of which is generally horse-shoe shaped. As best seen in FIGS. 2-3, the clips 70 are separate from each other and each follow the contours of the sleep surface's 20 perimeter. As best seen in FIGS. 5-6, 7A and 7B, each one of the clips 70 has multiple press-fit pegs 72 with detents 74 that pass through the holes 64 in the lower edges 62 and are secured into corresponding locking holes 76 (see FIGS. 4 and 6) in the sleep surface 20.

In operation, the lower edges 62 are disposed between the clips 70 and the sleep surface 20, and the pegs 72 are passed through the holes 64 in the lower edges 62 and into the locking holes 76 to sandwich the lower edges 62 between the clips 70 and the sleep surface 20. The lower edges 62 can be detached by pulling up on the clips 70 which causes the pegs 72 to compress and release from the locking holes 76.

Upper edges 80 of the sidewall structure 24 may also be removably attached to the upper support rail 22. Referring to FIGS. 12A-C, the upper edges 80 is configured to wrap around the upper support rail 22 and be secured in a tubular configuration around the upper support rail 22. For example, the upper edge 80 can include one or more zippers 82 that secures the upper edges 80 around the upper support rail 22 when zipped and which can be unzipped to disconnect the upper edge 80 from the upper support rail 22. However, forms of securement other than a zipper(s) 82 can be used, such as snaps, buttons, hook and loop fasteners, and the like. In another embodiment, the upper edge 80 can be continuous and the upper support rail 22 can be passed through the upper edge 80 (for example by disconnecting some or all of the upper support rail 22). The upper edges 80 can also have padding built therein such that when the upper edges 80 are secured around the upper support rail 22, the padding surrounds the upper support rail 22 to provide a soft cushioned surface to the upper support rail 22.

Figure 8:
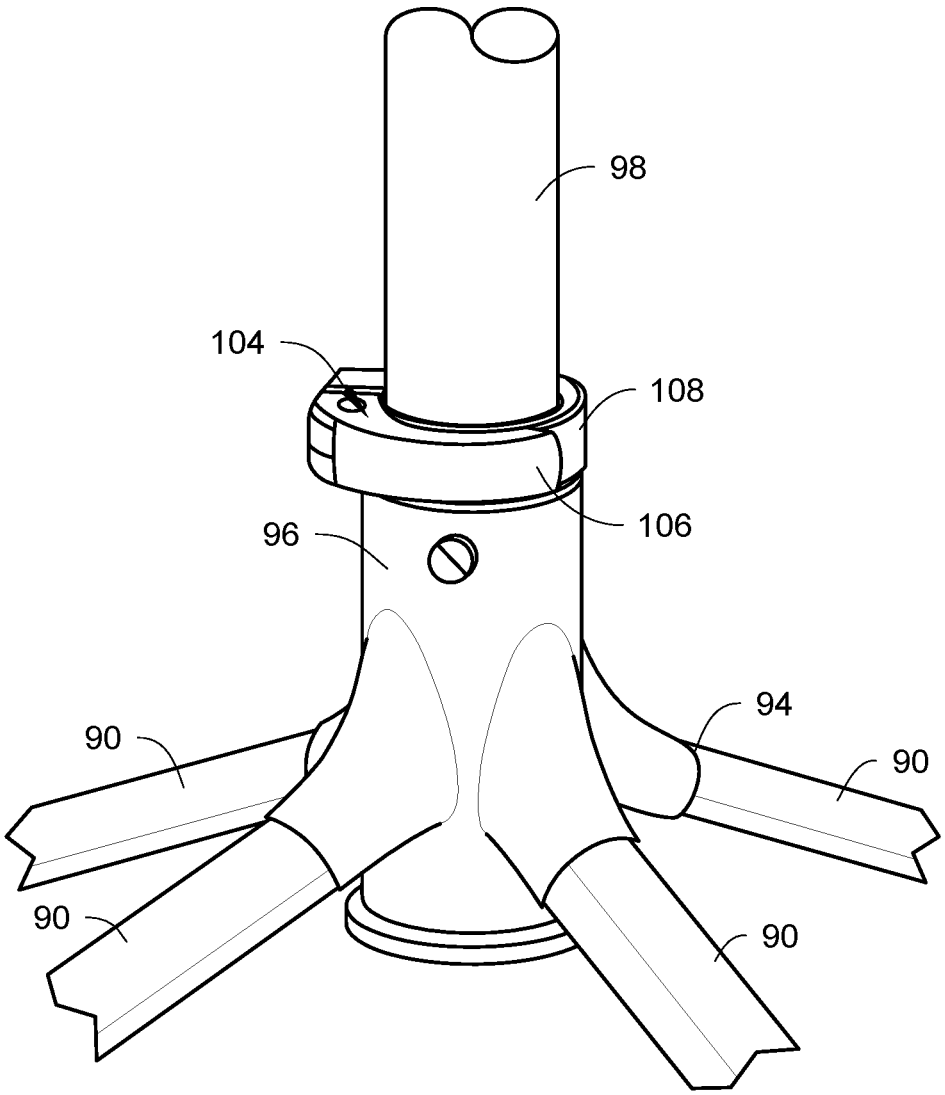
FIG. 8 depicts a hub and support pole of the support base of the infant sleep device.

Referring to FIGS. 1-2 and 8, the support base 14 supports the sleep enclosure portion 12 of the infant sleep structure 10 in a raised position above the floor 16. The support base 14 includes a plurality of support legs 90, for example three or four or more support legs 90, with each support leg 90 having a first end 92 that engages the floor and a second end 94 raised a distance above the floor and connected to a central hub 96. In one embodiment, the support legs 90 may be substantially straight or linear over some or all of their length between the first end 92 and the second end 94.

With continued reference to FIGS. 1-2 and 8, a support pole 98 is supported at a lower end 100 thereof by the central hub 96 and an upper end 102 of the support pole 98 supports the sleep surface 20. The central hub 96 can be hollow and the lower end 100 of the support pole 98 can extend through the central hub 96 to a point below the central hub 96 as best seen in FIGS. 1 and 8. An adjustment mechanism 104 is provided, for example on the central hub 96, that allows the support pole 98 to be vertically adjusted relative to the central hub 96, thereby adjusting the height of the sleep surface 20. For example, as depicted in FIG. 8, the adjustment mechanism 104 can comprise a cam lock mechanism that includes a pivoting actuating lever 106 and a clamping collar 108 whose diameter can be controlled by the lever 106 to clamp the support pole 98 to lock the vertical position of the support pole 98 or loosen the support pole 98 to allow vertical adjustment of the support pole 98. This adjustment mechanism 104 provides infinite degrees of height adjustment of the support pole 98.

Other forms of the support base 14 are also possible. For example, referring to FIG. 11, the support base 14 is depicted as including a pair of the support legs 90 and a cantilevered support pole 98 extending from the support legs. In this embodiment, the support pole 98 extends upwardly at an angle, and has a telescoping tube construction with one pole portion 98*a* telescoped within a second pole portion 98*b* with the adjustment mechanism 104 in the form of a clamp to allow height adjustment of the pole portion 98*a* relative to the second pole portion 98*b*. The sleep enclosure portion 12 can have a construction like described above.

Referring to FIGS. 9A, 9B, 10A, 10B and 10C, the sleep surface 20 and the support base 14 are configured to allow removal of the sleep enclosure portion 12, including the sleep surface 20, from the support base 14. The attachment between the sleep surface 20 and the support base 14 can have any configuration that permits non-destructive removal of the sleep enclosure portion 12, or removal of the sleep surface 20, from the support base 14. The sleep surface 20 can be used as a sleep surface both when the sleep surface 20 is attached to the support base 14 and when the sleep surface 20 is detached from the support base 14. For example, when the sleep surface 20 is detached from the support base 14, the upper support rail 22 and the sidewall structure 24 remain attached to the sleep surface 20 and function in the same manner as when the sleep surface 20 is attached to the support base 14.

For example, as best seen in FIGS. 9A and 9B, the second/outer ring 36 includes a plurality of tabs or ribs 120 that are circumferentially spaced from one another around the diameter of the second/outer ring 36 and each of which extends radially inwardly toward the first/inner ring 34. The example depicted in FIGS. 9A and 9B illustrates nine of the tabs 120, but a smaller or larger number of the tabs 120 can be used.

In addition, referring to FIGS. 10A-C, a sleep surface connector 122 is disposed at the upper end 102 of the support pole 98. The sleep surface connector 122 includes a first, large diameter portion 124 and a second, smaller diameter portion 126 that extends upwardly from the large diameter portion 124. The smaller diameter portion 126 is configured to fit within the second/outer ring 36 of the sleep surface 20. A pair of diametrically opposite spring biased clips 128*a*, 128*b* are provided in the smaller diameter portion 126. The clips 128*a*, 128*b* are biased radially outward so that tip ends 130 thereof project beyond the perimeter of the smaller diameter portion 126 as depicted in FIG. 10A. The tip ends 130 of the clips 128*a*, 128*b* are configured to latch over the tabs 120 of the second/outer ring 36. A manually actuated pull handle 132, seen in FIG. 10C, is user accessible on the sleep surface connector 122 to allow a user to retract the tip ends 130 of the clips 128*a*, 128*b* by the user pulling the pull handle 132 radially outward in the direction of the arrow in FIG. 10C, with their fingers/hand disposed in a recess 133 of the pull handle 132. When the tip ends 130 are retracted, the clips 128*a*, 128*b* clear the tabs 120 allowing removal of the sleep surface 20 or installation of the sleep surface 20 onto the sleep surface connector 122. In addition, the tip ends 130 include an angled or sloped surface 134. When mounting the sleep surface 20 onto the sleep surface connector 122, rather than using the pull handle 132 to retract the clips 128*a*, 128*b*, one or more of the tabs 120 engage the angled surface 134 of each tip end 130. This engagement, together with the weight of the sleep surface 20, forces the clips 128*a*, 128*b* inward against the biasing force to allow the tabs 120 to latch under the clips 128*a*, 128*b*, with the biasing force on the clips 128*a*, 128*b* forcing the clips radially outward to latch over the tabs 120 once the tabs 120 clear the tip ends 130.

In one embodiment, the tip ends 130 have a circumferential length that is greater than the distance between adjacent ones of the tabs 120 of the second/outer ring 36. This permits the sleep surface 20 of the sleep enclosure portion 12 to be mounted to the sleep surface connector 122 of the support base 14 in any rotational orientation. In addition, the smaller diameter portion 126 can include a central opening 136 that receives a circular protrusion 138 of the solid portion 30 of the sleep surface 20 to help orient the sleep surface 20 on the sleep surface connector 122. With this construction, the sleep surface 20 can rotate freely relative to the sleep surface connector 122 about a vertical axis. In addition, it is preferred that the sleep surface connector 122 be able to rotate freely relative to the support pole 98 about the axis of the support pole 98.

Referring to FIGS. 14-16, another version of a detachable connection between the sleep enclosure portion or the sleep surface 20 and the support base that permits free rotation of the sleep surface 20 is depicted. Elements in FIGS. 14-16 that are the same as or similar to elements in FIGS. 1-13 are referenced using the same reference numerals. The attachment mechanism described and illustrated in FIGS. 14-16 can be used in place of the clips 128*a*, 128*b* described above. However, the attachment mechanism can be actuated by a pull handle like the pull handle 132 described above. The tabs 120 illustrated in FIG. 14 are optional and may not be present in this embodiment.

In particular, referring to FIGS. 14-16, a protrusion 140 extends downwardly from the sleep surface 20, for example at the location of the circular protrusion 138 described above. The protrusion 140 includes a circumferential shoulder 142 that extends circumferentially around the axis of the protrusion 140 and that projects radially from the protrusion 140. The shoulder 142 may also have an angled or sloped ramp surface 144 and a radially extending lock surface 146.

A spring biased slide 148 is slidably disposed on the support base, for example in the sleep surface connector 122 (see FIG. 10A). The slide 148 is connected to and actuated by the pull handle 132 (See FIG. 10B) from a connected position (FIGS. 15-16) to a disconnected position. In an embodiment, the slide 148 and the pull handle 132 can be integrated together into a single, unitary part. Referring to FIG. 15, the slide 148 is biased by a spring or other biasing mechanism toward the right in FIG. 15 to the connected position. The slide 148 is actuated by the pull handle 132 against the bias of the biasing mechanism toward the left in FIG. 15 to permit the sleep surface 20 to be disconnected from the sleep surface connector and from the support base. As best seen in FIGS. 15-16, the slide 148 has a hole or passage 150 that allows passage of the protrusion 140 therethrough. The hole 150 includes a tab 152 that projects inwardly into the hole 150. The tab 152 includes an angled or sloped ramp surface 154 and a radially extending lock surface 156. Upon connecting the sleep surface 20 to the sleep surface connector, the ramp surface 144 on the protrusion 140 engages the ramp surface 154 on the tab 152 which forces the slide 148 to slide to the left in FIG. 16 until the shoulder 142 clears the tab 152 at which point the biasing mechanism forces the slide 148 back to the right in FIG. 16 so that the tab 152 snaps over the shoulder 142 with the lock surface 156 engaged with the lock surface 146. To disconnect, the user pulls the pull handle, such as the pull handle 132, which forces the slide 148 to the left in FIGS. 15-16 until the tab 152 clears the shoulder 142 at which time the sleep surface 20 can be removed from the support base.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An infant sleep device, comprising:

a sleep enclosure portion having a sleep surface, an upper support, and a sidewall structure that extends between the sleep surface and the upper support to define an enclosed area;

the sidewall structure includes a mesh sidewall portion, an upper edge and a lower edge;

a first type of attachment mechanism that is configured to removably attach the upper edge of the sidewall structure to the upper support; and a second type of attachment mechanism that is configured to removably attach the lower edge of the sidewall structure to the sleep surface, and the second type of attachment mechanism differs in construction from the first type of attachment mechanism.

2. The infant sleep device of claim 1, wherein the first type of attachment mechanism comprises a zipper, and the second type of attachment mechanism comprises at least one fastener that detachably connects to the sleep surface and to the sidewall structure.

3. The infant sleep device of claim 2, wherein the at least one fastener comprises at least one detachable clip.

4. The infant sleep device of claim 2, wherein the at least one fastener is configured so that the lower edge of the sidewall structure is disposed between the at least one fastener and the sleep surface.

5. The infant sleep device of claim 1, further comprising a support base that is connected to the sleep enclosure portion and supports the sleep enclosure portion above a floor.

6. The infant sleep device of claim 5, wherein the support base includes a sleep surface connector, a hub spaced from the sleep surface connector, and a support pole; the sleep surface connector is attached to the sleep enclosure portion; the support pole has an upper end connected to the sleep surface connector and a lower end that extends through the hub.

7. The infant sleep device of claim 6, wherein the support base further includes at least three support legs, each support leg having a first end that engages the floor and a second end raised a distance above the floor, and the second ends are connected to the hub, and the hub is disposed above the floor.

8. The infant sleep device of claim 7, further comprising an adjustment mechanism on the hub that controls vertical movement of the support pole relative to the hub whereby the height of the sleep enclosure portion above the floor can be adjusted.

9. The infant sleep device of claim 1, wherein the upper support is movable between a raised position and a lowered position, the upper support is biased upward toward the raised position; and further comprising a lock mechanism that temporarily locks the upper support at the lowered position.

10. The infant sleep device of claim 3, comprising two of the detachable clips, and each detachable clip is horse-shoe shaped and includes press-fit pegs with detents.

11. An infant sleep device, comprising:

a sleep enclosure portion having a sleep surface with an upper surface upon which a mattress is disposed during use, an upper support, and a sidewall structure that extends between the sleep surface and the upper support to define an enclosed area;

the sidewall structure includes a mesh sidewall portion, an upper edge and a lower edge;

a first attachment mechanism that is configured to removably attach the upper edge of the sidewall structure to the upper support; and a second attachment mechanism that is configured to removably attach the lower edge of the sidewall structure to the sleep surface;

the second attachment mechanism is not a zipper.

12. The infant sleep device of claim 11, wherein the second attachment mechanism comprises at least one detachable fastener that detachably connects to the sleep surface and to the sidewall structure.

13. The infant sleep device of claim 12, wherein the at least one detachable fastener comprises at least one detachable clip.

14. The infant sleep device of claim 12, wherein the at least one detachable fastener is configured so that the lower edge of the sidewall structure is disposed between the at least one detachable fastener and the sleep surface.

15. The infant sleep device of claim 11, further comprising a support base that is connected to the sleep enclosure portion and supports the sleep enclosure portion above a floor.

16. The infant sleep device of claim 15, wherein the support base includes a sleep surface connector, a hub spaced from the sleep surface connector, and a support pole; the sleep surface connector is attached to the sleep enclosure portion; the support pole has an upper end connected to the sleep surface connector and a lower end that extends through the hub.

17. The infant sleep device of claim 16, wherein the support base further includes at least three support legs, each support leg having a first end that engages the floor and a second end raised a distance above the floor, and the second ends are connected to the hub, and the hub is disposed above the floor.

18. The infant sleep device of claim 17, further comprising an adjustment mechanism on the hub that controls vertical movement of the support pole relative to the hub whereby the height of the sleep enclosure portion above the floor can be adjusted.

19. The infant sleep device of claim 11, wherein the upper support is movable between a raised position and a lowered position, the upper support is biased upward toward the raised position; and further comprising a lock mechanism that temporarily locks the upper support at the lowered position.

20. The infant sleep device of claim 13, comprising two of the detachable clips, and each detachable clip is horseshoe shaped and includes press-fit pegs with detents.

* * * * *